US010058471B2

(12) United States Patent
Vaughan et al.

(10) Patent No.: US 10,058,471 B2
(45) Date of Patent: Aug. 28, 2018

(54) SYSTEM AND METHOD OF USING HYPERBARIC OXYGEN THERAPY FOR TREATING CONCUSSIVE SYMPTOMS AND MUSCULOSKELETAL INJURIES AND FOR PRE-TREATMENT TO PREVENT DAMAGE FROM INJURIES

(71) Applicants: William M. Vaughan, Panama City, FL (US); Gerald W. Surrett, Lakewood, WA (US)

(72) Inventors: William M. Vaughan, Panama City, FL (US); Gerald W. Surrett, Lakewood, WA (US)

( * ) Notice: Subject to any disclaimer, the term of this patent is extended or adjusted under 35 U.S.C. 154(b) by 563 days.

(21) Appl. No.: 14/626,396

(22) Filed: Feb. 19, 2015

(65) Prior Publication Data

US 2015/0238379 A1 Aug. 27, 2015

Related U.S. Application Data

(60) Provisional application No. 61/942,910, filed on Feb. 21, 2014.

(51) Int. Cl.
*A61G 10/02* (2006.01)

(52) U.S. Cl.
CPC ..... *A61G 10/026* (2013.01); *A61G 10/023* (2013.01)

(58) Field of Classification Search
CPC ..... A61G 10/023
See application file for complete search history.

(56) References Cited

U.S. PATENT DOCUMENTS 3,744,491 A * 7/1973 Fischer ..... A61M 35/00 604/23
4,236,513 A * 12/1980 LoPiano ..... A61H 9/0071 601/166
4,620,538 A * 11/1986 Koegel ..... A61M 16/06 128/201.23
4,969,881 A * 11/1990 Viesturs ..... A61F 13/00068 128/888
4,974,829 A * 12/1990 Gamow ..... A61G 10/026 128/200.12
5,029,579 A * 7/1991 Trammell ..... A61H 9/0071 128/202.12

(Continued)

FOREIGN PATENT DOCUMENTS

RU 2010117594 A 11/2011
SU 1560203 A1 * 4/1990

OTHER PUBLICATIONS

Greensmith, J. Eric, Hyperbaric Oxygen Therapy in Extremity Trauma, 2004, J Am Acad Orthop Surg 12:376-384.*

(Continued)

*Primary Examiner* — Paula L Craig
(74) *Attorney, Agent, or Firm* — Laurence A. Greenberg; Werner H. Stemer; Ralph E. Locher

(57) ABSTRACT

A system and method are provided for performing hyperbaric oxygen therapy treatment to stop a cascading effect of an inflammatory response to an injury. Hyperbaric oxygen therapy is performed during the inflammation to suppress the release of cytokines, most preferably, within 72 hours of sustaining the injury. Subject to evaluation of the patient, at least a second hyperbaric oxygen therapy treatment is performed.

20 Claims, 6 Drawing Sheets

(56) References Cited

U.S. PATENT DOCUMENTS 5,060,644 A * 10/1991 Loori ..... A61G 10/026 128/202.12
5,582,574 A * 12/1996 Cramer ..... A61G 10/026 128/205.26
5,662,625 A 9/1997 Westwood
5,797,403 A * 8/1998 DiLorenzo ..... A61B 90/40 128/849
5,819,728 A * 10/1998 Ritchie ..... A62B 17/04 128/201.22
5,865,722 A * 2/1999 Heng ..... A61M 35/00 600/21
6,283,123 B1 9/2001 Van Meter et al.
6,443,148 B1 * 9/2002 Rodocker ..... A61G 10/026 128/202.12
6,548,061 B1 * 4/2003 Steeves ..... A61K 39/3955 424/130.1
6,814,076 B2 * 11/2004 Shusterman ..... A61G 10/023 128/204.18
7,198,045 B2 * 4/2007 Risley ..... A61G 10/026 128/202.12
7,540,283 B2 6/2009 Loori et al.
2002/0192240 A1 * 12/2002 Brooks ..... A61K 38/4893 424/247.1
2004/0006926 A1 * 1/2004 Neeley ..... A63B 69/00 52/6
2004/0261796 A1 * 12/2004 Butler ..... A61G 10/026 128/205.26
2005/0056285 A1 * 3/2005 Harris ..... A61G 10/026 128/205.26
2005/0178387 A1 * 8/2005 Gurnee ..... A61G 10/026 128/205.26
2006/0169284 A1 * 8/2006 Meyer ..... A61G 10/026 128/205.26
2006/0185670 A1 * 8/2006 Loori ..... A61G 10/026 128/202.12
2006/0201504 A1 * 9/2006 Singhal ..... A61M 16/00 128/204.18
2008/0066758 A1 * 3/2008 Richardson ..... A61G 10/026 128/205.26
2008/0210234 A1 * 9/2008 O'Brien ..... A61G 10/026 128/202.12
2009/0217930 A1 * 9/2009 Holley ..... E04B 1/166 128/205.26
2010/0178347 A1 * 7/2010 Bullock ..... A61K 9/0019 424/489
2010/0316729 A1 12/2010 Franks et al.
2010/0316733 A1 * 12/2010 Locklear ..... A61K 31/355 424/641
2011/0240017 A1 * 10/2011 Butler ..... A61G 10/04 128/201.25
2012/0080036 A1 4/2012 Linton et al.
2012/0093764 A1 * 4/2012 Maharaj ..... A61K 33/00 424/85.1
2012/0238924 A1 * 9/2012 Avni ..... A61H 9/0092 601/46
2012/0266874 A1 10/2012 Kawakami et al.
2013/0035949 A1 * 2/2013 Saltzman ..... G06Q 50/22 705/2
2013/0047988 A1 * 2/2013 Delp, II ..... A61G 10/026 128/204.22
2014/0221480 A1 * 8/2014 Hua ..... A61K 31/18 514/538
2015/0059761 A1 * 3/2015 Allen ..... A61G 10/04 128/205.26

OTHER PUBLICATIONS

Rockswold, Gaylan L., et al., Results of a prospective randomized trial for treatment of severely brain-injured patients with hyperbaric oxygen,1992, J Neurosurg 76: 929-934.*
Rusyniak, Daniel E., et al., Hyperbaric Oxygen Therapy in Acute Ischemic Stroke: Results of the Hyperbaric Oxygen in Acute Ischemic Stroke Trial Pilot Study, 2003, Stroke 34:571-574.*
Kindwall, Eric, et al., Hyperbaric Medicine Practice, 1999, Best Publishing Company, Chapters 1-3, 9, 17, 22, 27, and 30-34.*
Harch et al., "A Phase I Study of Low-Pressure Hyperbaric Oxygen Therapy for Blast-Induced Post-Concussion Syndrome and Post-Traumatic Stress Disorder", Journal of Neurotrauma 29:168-185 (Jan. 1, 2012).
Wortzel et al., "A Phase I Study of Low-Pressure Hyperbaric Oxygen Therapy for Blast-Induced Post-Concussion Syndrome and Post-Traumatic Stress Disorder: A Neuropsychiatric Perspective" Journal of Neurotrauma 29: 2421-2424 (Sep. 20, 2012), Letters to the Editor.

* cited by examiner

SYSTEM AND METHOD OF USING HYPERBARIC OXYGEN THERAPY FOR TREATING CONCUSSIVE SYMPTOMS AND MUSCULOSKELETAL INJURIES AND FOR PRE-TREATMENT TO PREVENT DAMAGE FROM INJURIES

CROSS-REFERENCE TO RELATED APPLICATIONS

The present application claims priority from Provisional Patent Application No. 61/942,910, filed on Feb. 21, 2014; that application being incorporated herein, by reference, in its entirety.

BACKGROUND OF THE INVENTION

Field of the Invention

The present invention relates to a medical treatment and, more particularly, to a system and method of using hyperbaric oxygen therapy to treat concussive symptoms and musculoskeletal injuries and for pre-treatment to prevent injuries, including neural damage from concussions.

Description of the Related Art

Professional athletes continue to lose valuable playing time and risk future health concerns from both the immediate trauma and the secondary effects of concussion incidents. Since 1996, the National Football League has collected data on the clinical signs, symptoms, medical actions and management of concussions in order to improve player safety. Data collected from 1996-2001 showed that of 1200 concussed players, 353 (29.4%) experienced repeat concussions. Information for the years 2002-2007 followed a similar pattern with 854 concussions and 154 suffering repeat head trauma.

The injuries and losses of players throughout a season have a significant impact on professional sports organizations. Specifically, the loss of players and participants in the National Hockey League (NHL), National Football League (NFL) and the World Boxing Federation (WBF) due to head trauma is significant. For example, in 2011 the NFL had a reported 122 players who missed games due to concussions costing NFL owners an estimated combined salary loss of over $7,320,000. The long term effects of head trauma leading to Chronic Brain Injury (CBI) have also drastically changed the approach to the safety of injured players, which has had an additional significant cost impact to professional sports organizations.

A concussion is a mild traumatic brain injury (mTBI). It is defined as a traumatically induced transient disturbance in brain function that involves a complex pathophysiological process. The blow or impulse force results in a neurometabolic cascade of pathophysiological events including ionic, metabolic and anatomic disturbances which lead to microscopic neuronal cell injury. This cascade of pathophysiological events 10 will now be described in connection with FIG. 1. More particularly, after an injury (step 20) to the brain, the inflammatory response causes the activation of microglial cells (step 30). Activated microglia release pro-inflammatory cytokines (step 40), which initially are productive in healing, but too much or repeated activation can be detrimental to the healing process. In particular, the release of pro-inflammatory cytokines in step 40 can cause blood vessels to leak (step 50), thus increasing pressure and decreasing oxygen to the cells (step 60). Decreased oxygen to the cells causes ischemia (step 70) to the brain cells which, if prolonged, causes cell death (step 80) and impairment (step 90). Therefore, activated microglia can lead to impaired recovery, neuronal death after the brain insult and a more severe final end state of the injury (step 95).

Most concussion symptoms last 24 to 72 hours in normal adults, but can last longer depending on the severity of the brain injury. The majority of concussions (80%-90%) resolve within 7-10 days. Symptoms that can be experienced during the recovery period are headache, dizziness and slight confusion. These symptoms result from the neurometabolic cascade of chemicals (10 of FIG. 1) released in response to injury sustained from the initial impact of the concussion discussed in connection with FIG. 1. These symptoms and the fear of exasperating the injury with early physical or cognitive activity or the exponential damage from a second impact injury during the recovery period are the major cause of time lost for the professional athlete.

Brain injuries are usually classified as mild, moderate or severe. These classifications are usually determined clinically by duration of loss of consciousness (LOC) and post-traumatic amnesia (PTA) following injury. For a "mild" classification the individual will usually have an LOC of less than 30 minutes and PTA of less than 1 day. With a "moderated" classification an individual will usually have an LOC of greater than 30 minutes but less than 24 hours and a PTA of 1 to 7 days. Severe brain injury can present with an LOC of greater than 24 hours and a PTA of more than 7 days.

According to the Walton Foundation over 5.3 million Americans are suffering some type of disability following a mTBI. The final disability is based on the severity of the initial injury and or repeated blows to the head over a period of several months or years. The symptoms of CBI are debilitating, long term and range from behavioral conflicts such as anxiety, depression and overwhelming sense of frustration to constant irritability and suicidal thoughts. There are cognitive issues as well that range from decreased short and long term memory and difficulty learning to overall poor judgment, insight and planning.

Some studies have looked at hyperbaric oxygen therapy (HBOT) for the treatment of mTBI. Those studies have had mixed results. In the majority of studies involving human subjects with mTBI, the subjects were treated with HBOT long after the damage had taken effect on the brain tissue, at which point the damage is most likely irreversible.

One of the failures of the current treatment of mTBI with HBOT is the delay in which the treatment is provided. Most HBOT treatments for mTBI have attempted to heal tissue already permanently damaged. See, for example, Some cases attempted to treat people who had severe head trauma and HBOT was not initiated until 72 months after injury. No studies, however, have tried to decrease or stop the initial cascade effects of a concussion in humans, which is the cause of most damage to the brain.

Additionally, HBOT has been attempted to treat musculoskeletal injuries, again long after the injuries have become permanent. See, for example, Russian Patent Application Publication No. RU2010117594 to Pulatovich.

The inventors of the present invention believe that managing the cascade effect is crucial to stopping the initial damage and providing the opportunity for a faster recovery. Accordingly, there is a need in the art for a new and improved system and method of treating concussive symptoms with hyperbaric oxygen therapy, wherein the initial cascade effect is curtailed before permanent impairment can occur.

SUMMARY OF THE INVENTION

The present invention is particularly suited to overcome those problems which remain in the art in a manner not previously known. More particularly, in accordance with one particular embodiment of the present invention, a system and method are provided which are capable of mitigating the initial, as well as the long term, damage of the trauma. Such system and method can accelerate the recovery time of concussive symptoms and can be capable of eliminating or reducing the post concussive symptoms. Such system and method should further provide a safe approach to treating concussion symptoms in an environment that is monitored by a trained and certified medical staff. In another particular embodiment of the invention, the system and method can also be used to treat musculoskeletal injuries, which have an inflammatory response similar to concussions and can benefit from the use of oxygen in the healing process in the same manner as concussions.

In one particular embodiment of the invention, hyperbaric oxygen therapy using pressures of 1.4 ATA up to 3.3 ATA are used to interrupt the damaging effects of the inflammatory response in the early stages of an injury. In another particular embodiment of the invention, more than one round of treatment with hyperbaric oxygen therapy is provided during the early stages of an injury, based upon an evaluation of the individual.

Other features, which are considered as characteristic for the invention, are set forth in the drawings and the appended claims.

Although the invention is illustrated and described herein as embodied in a system and method of using hyperbaric oxygen therapy for treating concussive symptoms and musculoskeletal injuries and for pre-treatment to prevent damage from injury, it is nevertheless not intended to be limited to the details shown, since various modifications and structural changes may be made therein without departing from the spirit of the invention and within the scope and range of equivalents of the claims.

The construction of the invention, together with additional objects and advantages thereof, will be best understood from the following description of the specific embodiments when read in connection with the accompanying drawings.

BRIEF DESCRIPTION OF THE DRAWINGS

For the purpose of illustrating the invention, there is shown in the drawings an exemplary embodiment that is presently preferred, it being understood however, that the invention is not limited to the specific methods and instrumentality's disclosed. Additionally, like reference numerals represent like items throughout the drawings. In the drawings.

BRIEF DESCRIPTION OF THE DRAWINGS

Figure 1:
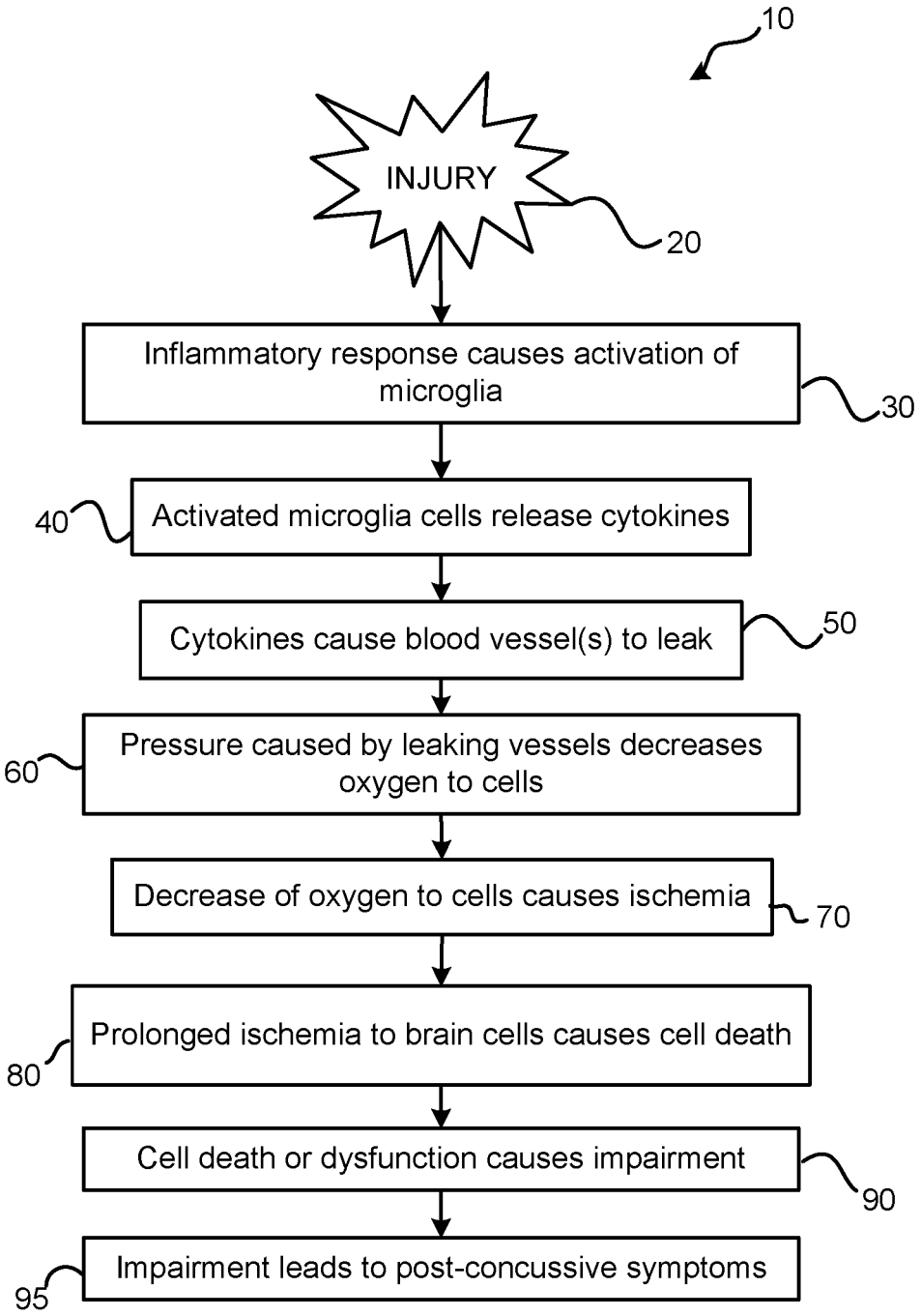
FIG. 1 (Prior Art)
FIG. 1 is a flow chart showing the cascade effect of a concussive injury.

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

Referring now to FIG. 2-5, there will be described a system and method of using hyperbaric oxygen therapy to treat concussive symptoms and musculoskeletal injuries and for pre-treatment before activity to prevent concussions in accordance with certain particular embodiments of the present invention. Although the detailed description below focuses on the treatment of concussive symptoms, it should be appreciated that the present invention may also be used to treat musculoskeletal injuries and to pre-treat subjects to reduce the likelihood of concussions.

Concussions have recently come to the forefront of athletic injuries. Every level of competition from little league sports to the professional athletic levels are currently working on mitigating the cause and long term effect of the concussed athlete. Millions of dollars are lost each year to the inability of players and organizations to find a therapeutic answer to helping the recovery process and eliminating the damage that causes mild traumatic brain injury (mTBI). Past attempts of using hyperbaric oxygen therapy (HBOT) have only focused on treating an already damaged brain. This delay in treatment has manifested into a belief that HBOT has limited effect on concussed personnel. Prior attempts at treatment have erred in not recognizing the need for oxygen therapy within a particular time frame after the injury, in order to prevent the damage of the cascade effect from an injury before permanent damage can occur. Stopping the cascade effect before the completion of metabolic cell damage will increase recovery, possibly eliminating post concussive symptoms and preventing the long term damage that has proven to cause chronic brain injury. The system and method of the present invention provides a safe, rapid and aggressive approach to treating concussion symptoms in an environment that is monitored by a certified medical staff.

HBOT is treatment by which 100% oxygen is administered to a patient at a pressure greater then sea level atmospheric pressure (1 atmosphere absolute or "ATA"). The increased pressure is obtained by putting the patient into a specially designed hyperbaric chamber. The increased pressure increases the partial pressure of oxygen ($PPO_2$), or basically the amount of oxygen within the blood. HBOT induces a much larger oxygen carrying capacity of the blood which drastically increases the driving force of oxygen diffusing into the tissues. This hyper-saturation of blood and subsequently tissue with oxygen improves the mitochondrial/tissue oxygenation. This results in improved tissue utilization of oxygen and leads to faster and better healing. This efficient and enhanced healing constitutes the net effect of HBOT.

There are several different methods for physicians and trainers to identify mTBI. The International Conference on Concussions in Sports (ICCS) recommends the use of the Sport Concussion Assessment Tool 3 (SCAT3). This guideline is used for management of both the concussion and recovery after injury. In combat, the Military Acute Concussion Evaluation (MACE) is an excellent tool for rapidly identifying concussions on the battlefield. Finally, physician experience and the presence of symptoms in a patient may lead to the determination that a person has suffered a concussion and requires further testing and evaluation. Individuals who have symptoms of mTBI (concussion) are eligible for the system and method of the present invention. Although these current methods are disclosed, it should be appreciated that any method now known or later developed may be utilized to identify mTBI symptoms, without departing from the scope and spirit of the present invention.

In accordance with one particular embodiment of the present invention, treatment is provided at the time that an individual initially presents to a physician with a mild traumatic brain injury (mTBI). In particular, in accordance with the present invention, as soon as a physician has determined an individual has sustained a concussion and is stable, HBOT protocol should begin. The introduction of HBOT in the initial stages after the concussion could reduce damage to the brain tissue by stopping the entire process (10 of FIG. 1) from continuing. Stopping the cascade effect at the beginning could decrease recovery time and stop the processes that cause CBI.

Figure 2:
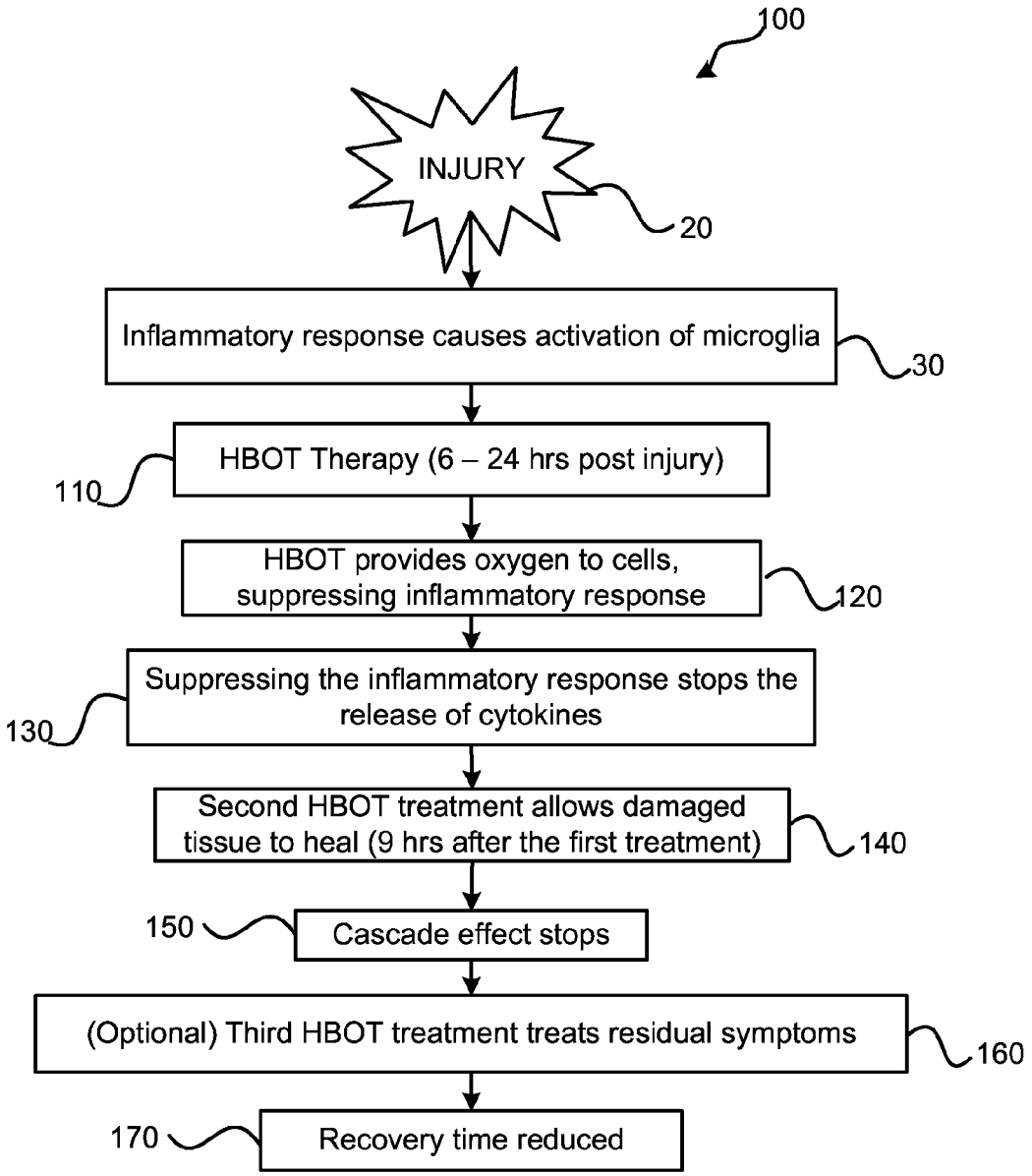
FIG. 2 is a flow chart showing the introduction of hyperbaric oxygen therapy to interrupt the cascade effect of a concussive injury in accordance with one particular embodiment of the present invention.

One particular method 100 of treating a mTBI will now be described in connection with FIG. 2. In accordance with the present invention, HBOT will be used to interrupt the cascade effect of a concussion after an injury (step 20), before the activated microglia (step 30) release enough cytokines to cause blood vessel leakage. A patient presenting to a physician or medical professional after an injury will be evaluated to determine a level of injury. If mTBI is diagnosed and the injury occurred within a predefined time window, the patient is placed into a hyperbaric chamber. In one particularly preferred embodiment of the invention, a multiplace hyperbaric chamber (having room for at least one patient and a medical professional) is used for treating the patient. However, this is not meant to be limiting, as a monoplace hyperbaric chamber could also be used, if desired.

The predefined time window for treatment is a time window for the most beneficial advantages of HBOT after the initial insult (step 20). In one particularly preferred embodiment of the invention, the time window for beginning HBOT for mTBI is within 6-24 hours after the initial insult (Step 110). In another particularly preferred embodiment of the invention, the predefined time window is between 1 and 72 hours after the initial injury. Other time windows can be defined in accordance with the present invention, in which the HBOT is performed while the cascade effect is still occurring in order to stop the cascade effect before permanent injury can result, without departing from the spirit of the present invention. In the particular preferred embodiment of FIG. 2, a patient presenting with mTBI within 24 hours after the occurrence of the initial injury will be treated with HBOT to provide more oxygen to the patient's brain tissues (step 120), which has been shown to reduce the inflammatory process. Reduction or suppression of the inflammatory process stops the release of cytokines (step 130). In one particular embodiment of the invention, the HBOT of step 110 is performed at pressures (i.e., "depths") of from 1.4 ATA to 3.3 ATA.

In accordance with the present preferred embodiment, a follow up treatment is performed within twenty-four hours after the conclusion of the first HBOT treatment. In one preferred embodiment, the follow up treatment is performed between 7 and 10 hours after the conclusion of the first treatment session, so as to allow damaged tissues to continue to heal more quickly and thoroughly. In a more preferred embodiment, the follow up treatment is performed on or about nine hours after the end of the first treatment session (step 140). Such a second HBOT can be also be performed from pressures of 1.4 ATA up to 3.3 ATA, if desired. The HBOT thus stops the cascade effect (step 150). Even more treatments (step 160) can be added to help reduce any residual symptoms that may still be present. By interrupting the cascade effect before the cytokines can be released in sufficient quantities to do damage, the recovery time is reduced (step 170).

The system and method of the present invention differs from other HBOTs in that, according to the present invention, the HBOT will be introduced immediately following insult (i.e., up to 72 hours following the injury), instead of the current process of only treating after post-concussive symptoms have been present for a long period of time or in the treatment of chronic brain injury where HBOT is used in an attempt to facilitate the healing of permanently damaged tissue or severe past head trauma. The immediate impact of HBOT directly after an insult resulting in mild or even possibly moderate traumatic brain injury may lead to faster recovery time, a more thorough healing of brain tissue and reduce the future possibility of CBI.

Similarly, in accordance with another embodiment of the present invention, HBOT from pressures of 1.4 ATA up to 3.3 ATA can also be used to interrupt the damaging effects of the inflammatory response in the early stages of a musculoskeletal injury. Musculoskeletal injuries involve an inflammatory response to injury similar to concussive injuries. As a result, the introduction of HBOT in the initial stages after the musculoskeletal injury could reduce the damage and speed the healing of musculoskeletal tissue after injury. This increased healing can allow professional athletes to return to competition in a shorter period of time.

Figure 3:
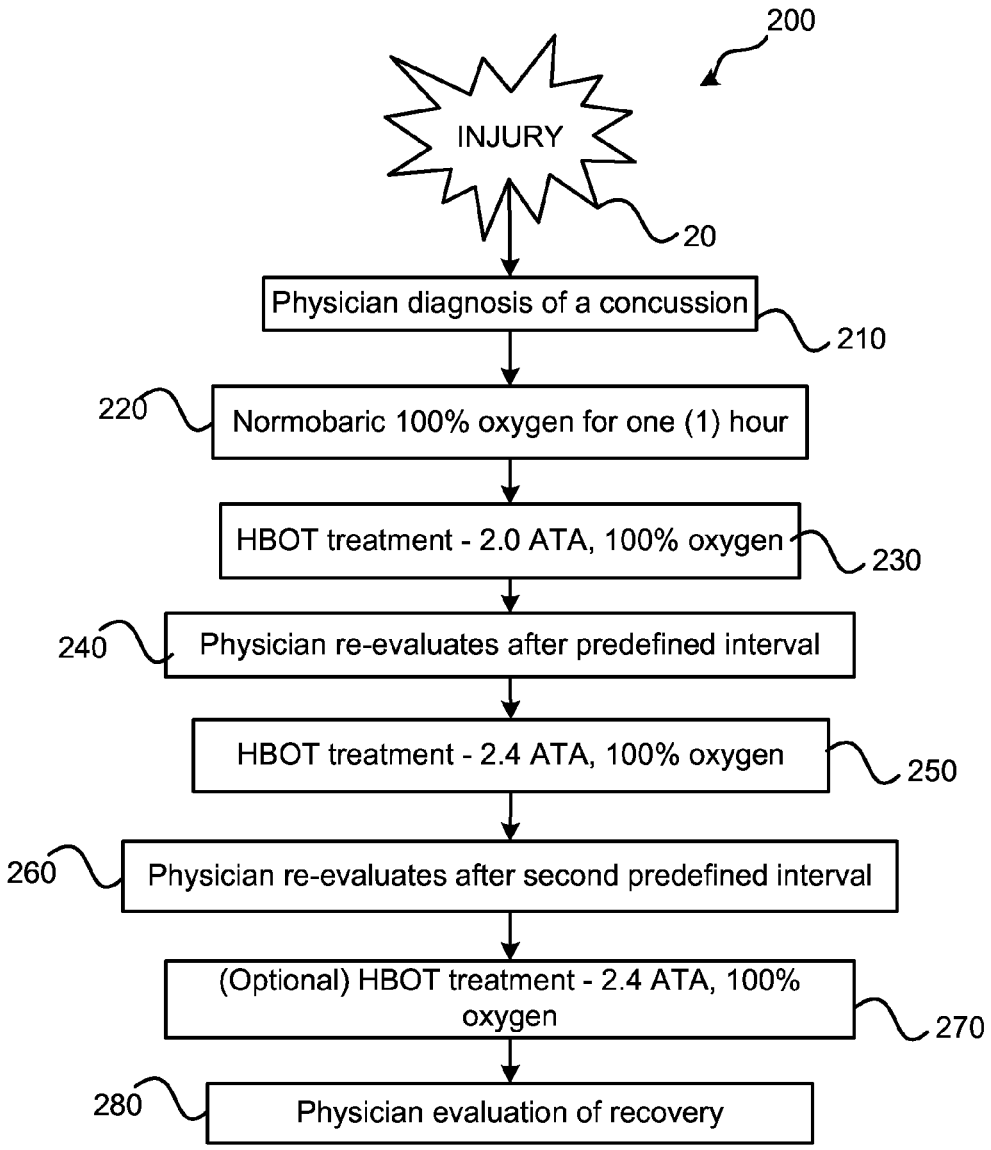
FIG. 3 is a flow chart showing the introduction of hyperbaric oxygen therapy to interrupt the cascade effect of a concussive injury in accordance with another particular embodiment of the present invention.

Another method 200 in accordance with another particular embodiment of the present invention will now be described in connection with FIG. 3. In the present embodiment, after an initial injury (step 20) and diagnosis of concussion (step 210), a person suffering from the mTBI is placed on normobaric oxygen (i.e., surface oxygen) for one hour (step 220). Note that the normobaric oxygen treatment can be administered for a longer or shorter amount of time, if desired.

Figure 4:
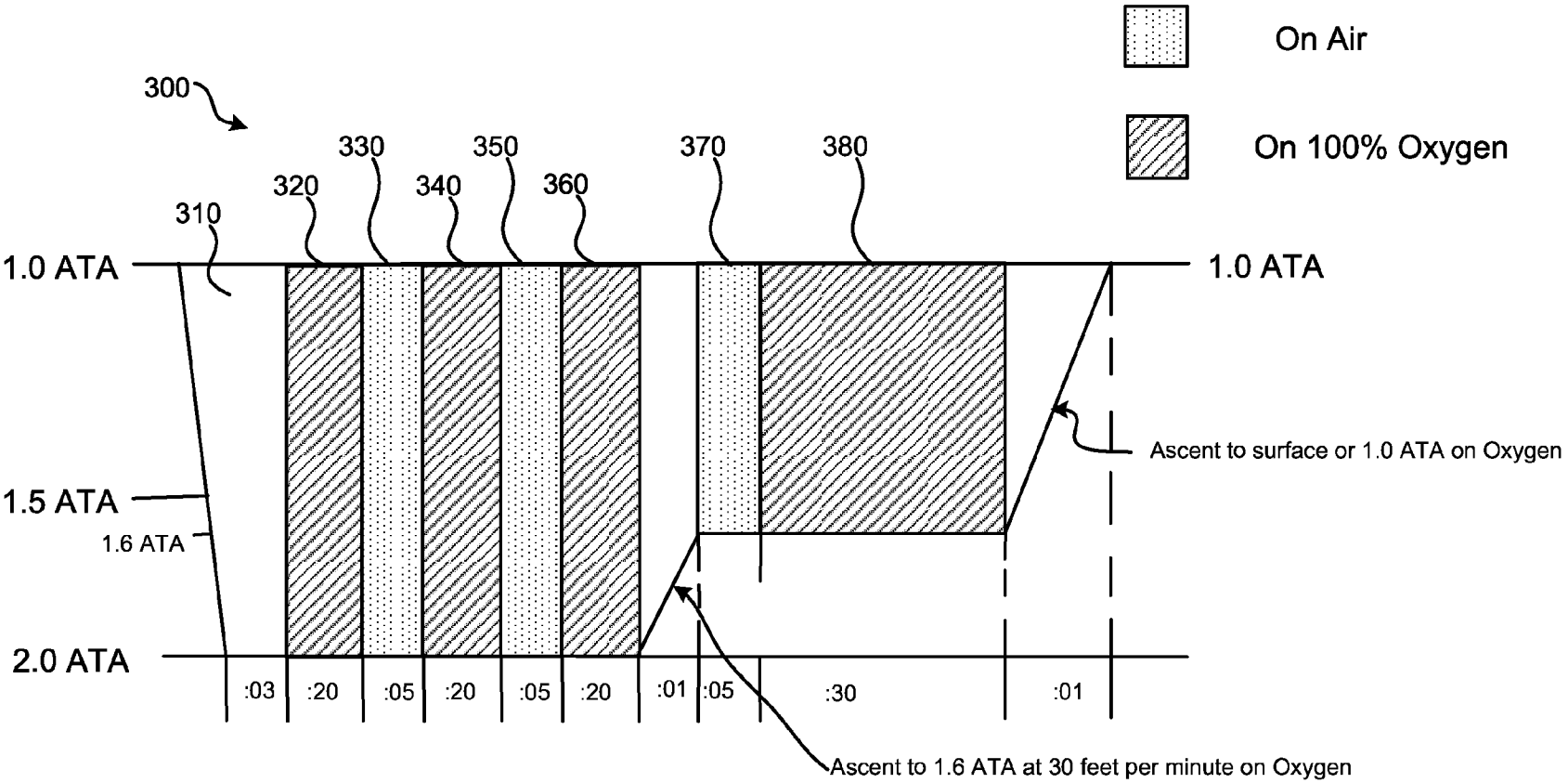
FIG. 4 is a timeline showing the levels and durations of hyperbaric oxygen for one treatment protocol in accordance with the present invention.

Once the individual is stable and has received the normobaric oxygen, a first HBOT is performed (step 230). In the present particular embodiment of FIG. 3, it is most preferable that the HBOT be performed between 6-24 hours after injury, however, up to 72 hours after injury is acceptable. One particular protocol for the first HBOT treatment is provided in FIG. 4, however this is not meant to be limiting, as it can be seen that other protocols may be used without departing from the spirit of the present invention. More particularly, the protocol of FIG. 4 is designed to provide the most efficient and safe method of introducing higher partial pressure oxygen to the tissues without risking decompression sickness (DCS) and limiting the concerns of Central Nervous System Oxygen toxicity ($CNSO_2$ toxicity). The oxygen breathing times and depths selected are based on data provided from successful HBOT as seen in past studies. The protocol used to reduce $CNSO_2$ toxicity was developed by introducing Air Breaks (21% $O_2$ 78% nitrogen). In the embodiment of FIG. 3, the HBOT treatment utilizes 100% oxygen while the patient is subjected to a pressure of 2.0 ATA.

Immediately upon completion of the first HBOT treatment, the patient will begin a short surface interval (i.e., breathing air at normobaric pressures) (step 230). In the present particular embodiment, the surface interval will last 9 hours, during which, physicians and trainers will have a full opportunity to evaluate and monitor the recovery process of the individual being treated (step 240).

In accordance with the present embodiment, immediately following the conclusion of the surface interval, a second HBOT treatment will be conducted at a slightly increased ATA (step 250). Increasing from an original treatment of 2.0 ATA to 2.4 ATA will provide more $PPO_2$ to damaged tissues. After initial treatments, studies have shown that as the inflammatory processes begins to recede, the uptake of oxygen by the tissues in the brain increases. Increasing the $PPO_2$ by increasing the pressure in the chamber will provide maximum oxygenation to the damaged tissues. It is noted that follow on treatments increase the oxygenation of tissues for up to 72 hours after the completion of HBOT. Thus, it is possible for the healing effect of increased oxygenation to remain in the tissues well after treatment is completed. This would lead to a continuation of the recovery process after immediate intervention is completed. One particular example of a possible protocol for the second HBOT treatment is provided in FIG. 5. Note that other protocols can be used for the second HBOT treatment without departing from the spirit of the present invention.

After completion of the second HBOT treatment, the patient will require another surface interval (i.e., the patient is given air at normobaric pressure) before any additional HBOT treatments can be undertaken. In one particularly preferred embodiment of the invention, this further surface interval is for or about 24 hours. This interval allows for the continued recovery of damage tissues and the re-evaluation of the injury by medical staff (step 260). If mild symptoms persist, a third HBOT treatment can be performed at similar pressures to that of the second HBOT treatment (step 270), after which the physician can evaluate the patient's recovery (step 280). One particular example of a protocol for the third HBOT treatment is provided in FIG. 6.

The completion of the HBOT protocol for mTBI should shorten the recovery time of residual symptoms and return the person to their day-to-day environment. For athletes, they should be able to return to the playing field sooner than they currently can with prior medical concussion treatments.

As indicated above, there are two types of hyperbaric treatment chambers available for clinical use. They are monoplace and multiplace hyperbaric chambers. Monoplace chambers are clear acrylic tubes ranging from 28-34 inches in diameter. Monoplace chambers are convenient and portable, but their small size causes a greater amount of claustrophobia then the larger multiplace chambers. Monoplace chambers also limit the access to the patient. This results in not having qualified medical personal with the patient under pressure to provide any medical needs necessary during treatment. Multiplace chambers provided a much larger treatment facility and allow for multiple personnel to be treated at one time and allow for a medical attendant to be present and under pressure with the patient(s) to ensure medical protocol and safety.

The HBOT treatment methods of the present invention can also be used as a pre-activity preventative treatment to reduce the likelihood of damage from concussions. More particularly, the inventors of the present invention believe that the cellular metabolic damage caused by mTBI can be slowed by using a neuroprotective pre-treatment approach using with HBOT. Specifically, athletes can receive HBOT pre-treatment prior to competition, which will provide oxygen to the tissues to saturate the brain tissues to possibly prevent the injury or stop the cascade effect of metabolic injury if the brain receives damage from external physical forces. As indicated above, the benefits of the HBOT treatments remain in the system for up to 72 hours after the completion of the HBOT treatment.

The HBOT treatment methods of the present invention can also be used for other pathologies beyond TBI. The HBOT treatment protocols described herein provide safe and effective HBOT Treatment that can be used not only for brain injuries, but also can assist in recovery from musculoskeletal injuries. The recovery from common injuries associated with athletic competition may be enhanced by HBOT therapy. The combination of physical therapy, medications and HBOT could provide a therapeutic treatment protocol that will provide and optimize the recovery of athletes providing distinct advantages to participating teams. Past attempts of treating musculoskeletal injuries in humans with HBOT were conducted with monoplace chambers at low pressures limiting the $PPO_2$ and lessoning the oxygenation of injured tissues. With multiplace chambers and the HBOT protocols described in connection with FIGS. 4 and 5, teams can provide a safe higher $PPO_2$ to damaged tissues and conduct physical therapy with trained medical personal while under pressure. This combination of HBOT and physical therapy under pressure could possibly provide two benefits. First, allowing the super saturation of oxygen to the body to enhance healing of damage tissue and second, to simultaneously allow physical therapy to the patient in order to strengthen and rehabilitate the injury during HBOT. Physical Therapy (PT) under pressure in a high oxygen environment would be limited due to the inability of certain electrical devices into the pressure environment. Modifications, however, to PT can be made for the most beneficial result for the patient. Use of HBOT has unlimited potential and advantages for providing recovery to athletes wanting to return to playing for their organizations.

Referring now to FIG. 4, there will be described one exemplary protocol 300 which can be used, in one embodiment, in connection with the first HBOT treatment of FIGS. 2 and 3. Note that this is not meant to be limiting, as other protocols can be used (i.e., other times and pressures) without departing from the spirit of the invention. More particularly, within 72 hours of sustaining an injury, and more preferably, within 6 to 24 hours of sustaining the injury, a patient is put into a hyperbaric chamber for HBOT treatment. In the preferred embodiment, the treatment is conducted in a multiplace chamber with medical personnel remaining under pressure with the patient for the duration of the treatment (i.e., 1 hour and 50 minutes, in the example of FIG. 4). The treatment protocol of FIG. 4 has no inside medical attendant oxygen breathing requirement, however. Initially, a descent time 310 of 3 minutes is provided to reduce barotraumas concerns. During this descent time 310, the pressure in the chamber is increased from 1.0 ATA to 2.0 ATA. The travel rate on the descent is not to exceed 10 feet per minute. Three, twenty minute periods 320, 340 and 360 are provided at 2.0 ATA in which the patient is breathing 100% oxygen. Five minute air breaks 330 and 350, in which the patient breathes a mixture of 21% oxygen and 78% nitrogen at 2.0 ATA, follow each of the oxygen breathing periods 320 and 340, respectively. In the present exemplary embodiment, upon completion of the third oxygen breathing period 360 at 2.0 ATA, the patient is slowly ascended (i.e., at 30 feet per minute) to 1.6 ATA on 100% oxygen. Upon arriving at 1.6 ATA, the patient is given a further 5 minute air break 370. While still at 1.6 ATA, the patient undergoes a further oxygen breathing period 380, wherein the patient is administered 100% oxygen for 30 minutes. Subsequent to the oxygen breathing period 380, the patient is returned to 1 ATA (i.e., surface) on oxygen and the HBOT treatment is concluded.

Figure 5:
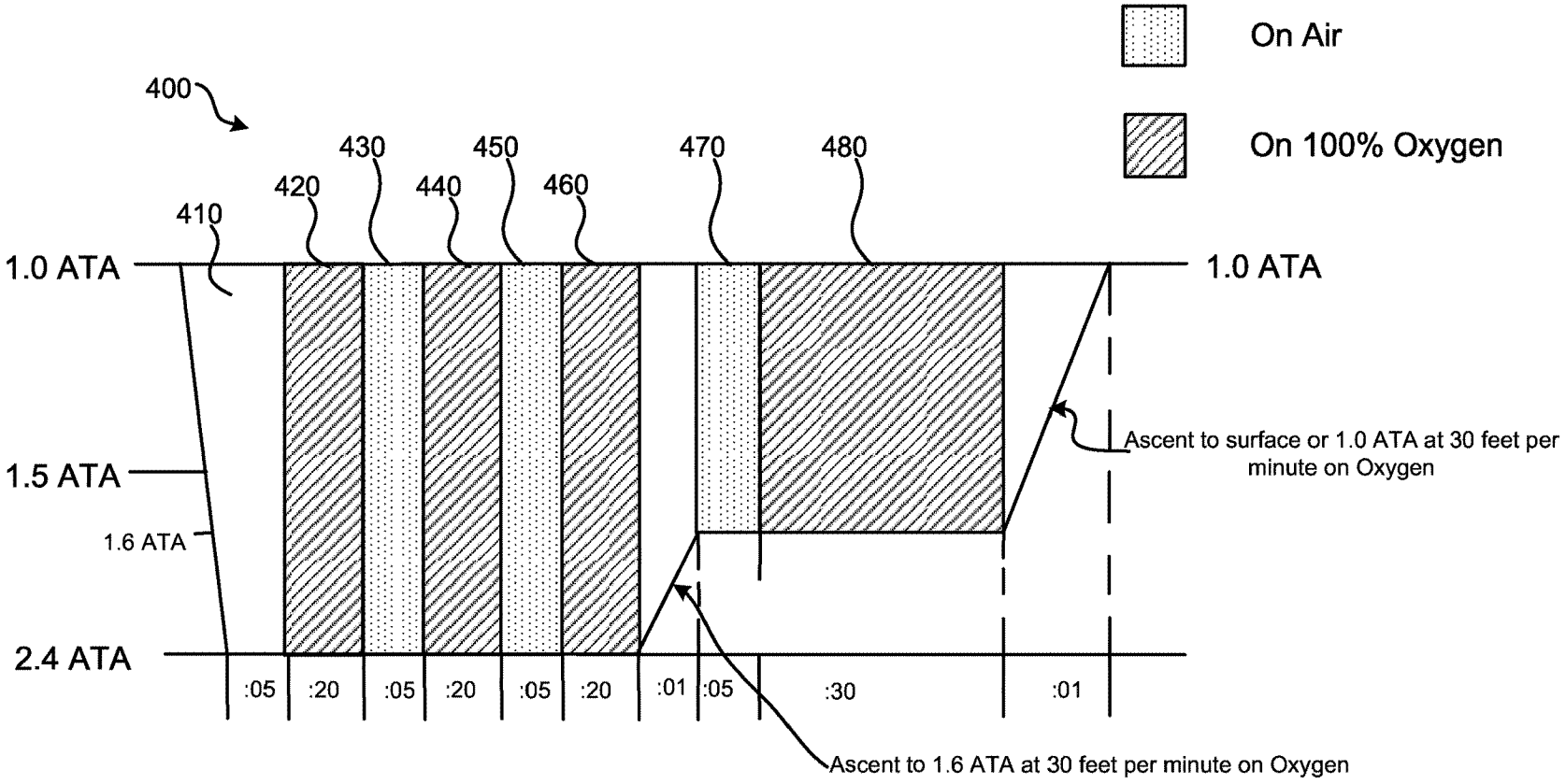
FIG. 5 is a timeline showing the levels and durations of hyperbaric oxygen for a second treatment protocol in accordance with the present invention.

Referring now to FIG. 5, there will be described one exemplary protocol 400 which can be used, in one embodiment, in connection with the second HBOT treatment of FIGS. 2 and 3. Note that this is not meant to be limiting, as other protocols can be used (i.e., other times and pressures) without departing from the spirit of the invention. More particularly, on or about 9 hours after the first HBOT treatment described herein, a further treatment is conducted in the multiplace chamber with medical personnel remaining under pressure with the patient for the duration of the treatment (i.e., 1 hour and 52 minutes, in the example of FIG. 5). In the treatment protocol 400 of FIG. 5, the medical attendant must breath 100% oxygen during the last, 15 minutes of treatment and during the last 15 minutes at 1.6 ATA. Due to the length of treatment, the medical attendant has absorbed enough nitrogen to require a decompression obligation. To eliminate the concern for decompression sickness (DSC), a 15 minute oxygen breathing period is required.

Initially, a descent time 410 of 5 minutes is provided to reduce barotraumas concerns. During this descent time 310, the pressure in the chamber is increased from 1.0 ATA to 2.0 ATA. The travel rate on the descent should not exceed 10 feet per minute. Three, twenty minute periods 420, 440 and 460 are provided at 2.4 ATA in which the patient is breathing 100% oxygen. Five minute air breaks 430 and 450, in which the patient breathes air (i.e., defined herein as a mixture of 21% oxygen and 78% nitrogen) at 2.4 ATA, follow each of the oxygen breathing periods 420 and 440, respectively. In the present exemplary embodiment, upon completion of the third oxygen breathing period 460 at 2.4 ATA, the patient is slowly ascended (i.e., at 30 feet per minute) to 1.6 ATA on 100% oxygen. Upon arriving at 1.6 ATA, the patient is given a further 5 minute air break 470. While still at 1.6 ATA, the patient undergoes a further oxygen breathing period 480, wherein the patient is administered 100% oxygen for 30 minutes. Subsequent to the 100% oxygen breathing period 480, the patient is returned to 1 ATA (i.e., surface) on oxygen at 30 feet per minute, and the HBOT treatment is concluded.

Figure 6:
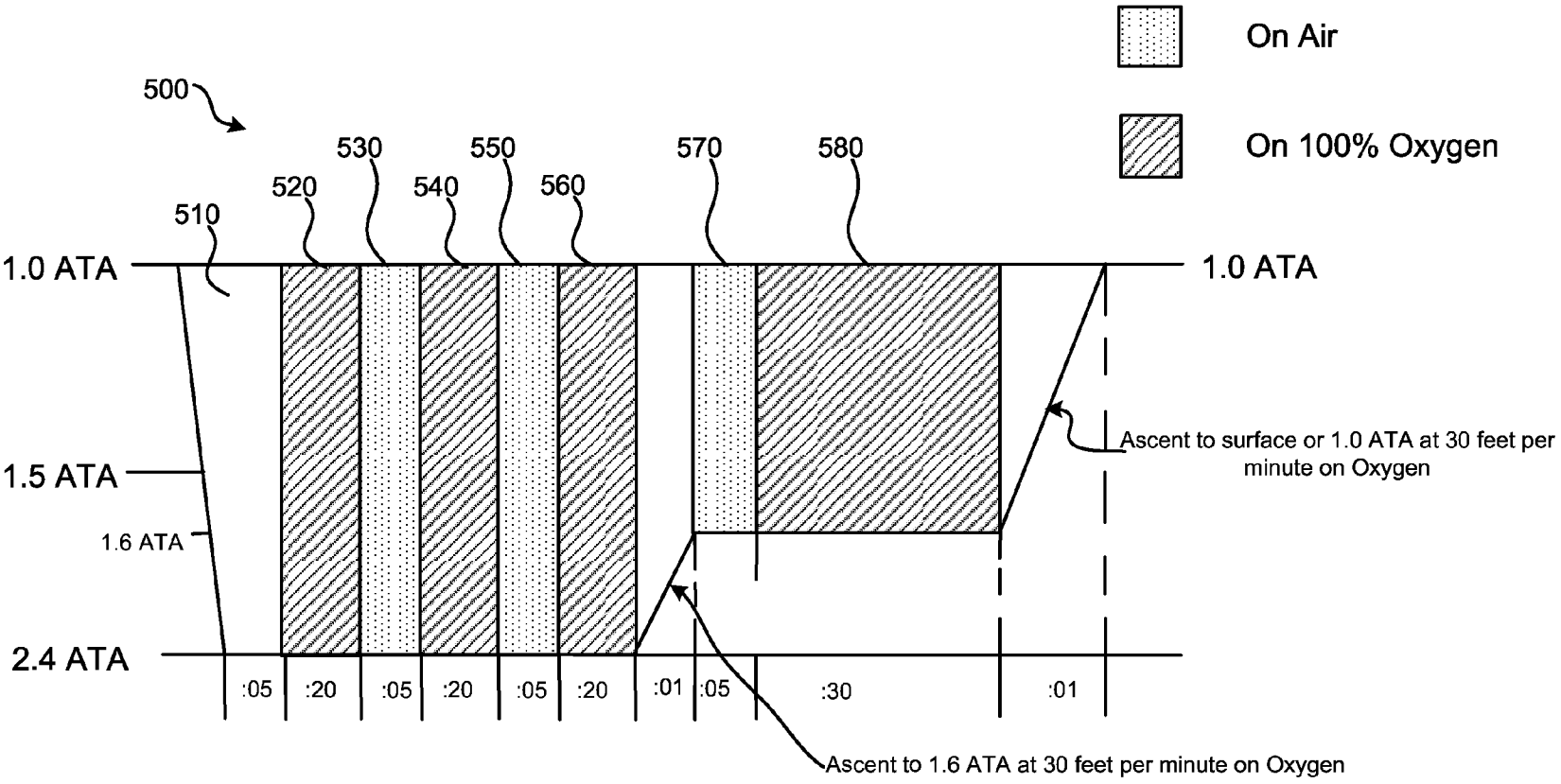
FIG. 6 is a timeline showing the levels and durations of hyperbaric oxygen for a third treatment protocol in accordance with the present invention.

In the event that the physician evaluating the patient concludes that a third (or more) HBOT treatment may be necessary, an exemplary third HBOT treatment protocol 500 is provided in FIG. 6. Note that this is not meant to be limiting, as other protocols can be used (i.e., other times and pressures) without departing from the spirit of the invention. More particularly, subsequent to the second HBOT treatment described herein, a further treatment is conducted in the multiplace chamber with medical personnel remaining under pressure with the patient for the duration of the treatment (i.e., 1 hour and 52 minutes, in the example of FIG. 6). In one particular embodiment of the invention, the third treatment occurs 24 hours after the conclusion of the second treatment. The HBOT treatment protocol 500 is substantially similar to that described in connection with the protocol 400 of FIG. 5. As with the protocol 400, in the treatment protocol 500 of FIG. 6, the medical attendant must breath 100% oxygen during the last, 15 minutes of treatment and during the last 15 minutes at 1.6 ATA in order to eliminate the concern for decompression sickness.

Initially, a descent time 510 of 5 minutes is provided to reduce barotraumas concerns. During this descent time 510, the pressure in the chamber is increased from 1.4 ATA to 2.4 ATA. The travel rate on the descent should not exceed 10 feet per minute. Three, twenty minute periods 520, 540 and 560 are provided at 2.4 ATA in which the patient is breathing 100% oxygen. Five minute air breaks 530 and 550, in which the patient breathes air (i.e., defined herein as a mixture of 21% oxygen and 78% nitrogen) at 2.4 ATA, follow each of the oxygen breathing periods 520 and 540, respectively. In the present exemplary embodiment, upon completion of the third oxygen breathing period 560 at 2.4 ATA, the patient is slowly ascended (i.e., at 30 feet per minute) to 1.6 ATA on 100% oxygen. Upon arriving at 1.6 ATA, the patient is given a further 5 minute air break 570. While still at 1.6 ATA, the patient undergoes a further oxygen breathing period 580, wherein the patient is administered 100% oxygen for 30 minutes. Subsequent to the 100% oxygen breathing period 580, the patient is returned to 1 ATA (i.e., surface) on oxygen at 30 feet per minute, and the HBOT treatment is concluded.

The benefits of the system and methods of the present invention extend past just mTBI treatment and recovery. The possibilities of rehabilitating musculoskeletal injuries with combination physical therapy and HBOT make this concept an invaluable addition to organizations that require advantages of reducing long term injury and decreased injury time.

While the invention has been described, disclosed, illustrated and shown in various terms of certain embodiments or modifications, which it has presumed in practice, the scope of the invention is not intended to be, nor should it be deemed to be, limited thereby and such other modifications or embodiments as may be suggested by the teachings herein are particularly reserved, especially as they fall within the breadth and scope of the claims.

We claim:

1. A method of treating a patient for an injury that results in an inflammatory response, comprising the steps of:

between 1 and 72 hours after an injury, putting the patient into a hyperbaric chamber and performing a first hyperbaric oxygen therapy treatment at a first pressure from 1.4 ATA to 3.3 ATA, the first hyperbaric oxygen therapy treatment including at least two oxygen breathing periods on 100% oxygen at the first pressure, separated by one period on air at the first pressure; and the first hyperbaric oxygen therapy treatment further including, after the at least two periods on 100% oxygen, decreasing the pressure to a second pressure lower than the first pressure but equal to or greater than 1.4 ATA, followed by one period on air at the second pressure for a period of time and, subsequently, by an oxygen breathing period on 100% oxygen at the second pressure for a period of time;

after the first hyperbaric oxygen therapy treatment, maintaining the patient under normobaric conditions for a surface interval of twenty-four hours or less; and upon the conclusion of the surface interval, performing a second hyperbaric oxygen therapy treatment on the patient at a third pressure different from the first pressure.

2. The method of claim 1, wherein the first hyperbaric oxygen therapy treatment is performed within 24hours of the injury.

3. The method of claim 1, wherein the first hyperbaric oxygen therapy treatment is performed within 6 to 24 hours of the injury.

4. The method of claim 1, wherein the surface interval is between 7 and 10 hours.

5. The method of claim 4, wherein the surface interval is about 9 hours.

6. The method of claim 1, wherein the first pressure is 2.0 ATA.

7. The method of claim 6, wherein the third pressure is 2.4 ATA.

8. The method of claim 1, further comprising the step of providing the patient with 100% oxygen under normobaric conditions for a first period of time prior to the first hyperbaric oxygen therapy treatment.

9. The method of claim 1, wherein the injury is a concussion or traumatic brain injury.

10. The method of claim 1, wherein the injury is a musculoskeletal injury.

11. The method of claim 1, wherein the second pressure is 1.6 ATA.

12. A method of treating a patient for an injury that results in an inflammatory response, comprising the steps of:

within 72 hours of the occurrence of the injury, placing the patient into a hyperbaric chamber and performing a first hyperbaric oxygen therapy treatment at a first pressure selected from 1.4 ATA to 3.3 ATA, the first hyperbaric oxygen therapy treatment including at least two oxygen breathing periods on 100% oxygen at the first pressure, separated by one air break period on air at the first pressure for a first duration; and the first hyperbaric oxygen therapy treatment further including, after the at least two periods on 100% oxygen, decreasing the pressure to a second pressure lower than the first pressure but equal to or greater than 1.4 ATA, followed by an air break period on air at the second pressure for a time period of a first duration and, subsequently, by an oxygen breathing period on 100% oxygen at the second pressure for time period of a second duration longer than the first duration;

after the first hyperbaric oxygen therapy treatment, maintaining the patient under normobaric conditions for a surface interval of twenty-four hours or less; and upon the conclusion of the surface interval, performing a second hyperbaric oxygen therapy treatment on the patient at a third pressure selected from 1.4 ATA to 3.3 ATA, the third pressure being different from the first pressure.

13. The method of claim 12 wherein performing the first hyperbaric oxygen therapy treatment further comprises the steps of:

after the at least two oxygen breathing periods, providing the patient with a further air break period on air at the first pressure; and after the further air break period, providing the patient with a third oxygen breathing period on 100% oxygen for at the first pressure, prior to decreasing the pressure to the second pressure.

14. The method of claim 12, wherein the pressure is decreased from the first pressure to the second pressure while providing 100% oxygen to the patient; and after the second hyperbaric oxygen therapy treatment, the pressure is reduced to a normobaric pressure while providing 100% oxygen to the patient.

15. The method of claim 12, wherein performing the second hyperbaric oxygen therapy treatment comprises the steps of:

increasing the pressure in the chamber to the third pressure;

at the third pressure, providing a first oxygen breathing period wherein 100% oxygen is provided to the patient for a time period of a first duration;

after the first oxygen breathing period, providing the patient with a first air break at the third pressure for a time period of a second duration;

after the first air break, providing the patient with a second oxygen breathing period at 100% oxygen at the third pressure for a time period of the first duration;

after the second oxygen breathing period, providing the patient with a second air break for a time period of the second duration; and after the second air break, providing the patient with a third oxygen breathing period of a time period of the first duration.

16. The method of claim 15, wherein the first pressure is 2.0 ATA and the third pressure is 2.4 ATA.

17. The method of claim 15, wherein the first duration of the first hyperbaric oxygen therapy treatment is 20 minutes and the second duration of the first hyperbaric oxygen therapy treatment is 5 minutes.

18. The method of claim 12, further comprising the steps of after the second hyperbaric oxygen therapy treatment, maintaining the patient under normobaric conditions for a surface interval of about twenty-four hours; and upon the conclusion of the surface interval, performing a third hyperbaric oxygen therapy treatment on the patient at a third pressure different from the first pressure.

19. A method of pre-treating a patient for an injury that results in an inflammatory response, comprising the steps of:

before an injury occurs that can cause an inflammatory response in the patient, putting the patient into a hyperbaric chamber and performing a first hyperbaric oxygen therapy treatment at a first pressure selected from 1.4 ATA to 3.3 ATA, the first hyperbaric oxygen therapy treatment including at least two oxygen breathing periods on 100% oxygen at the first pressure, separated by one period on air at the first pressure;

after the first hyperbaric oxygen therapy treatment, maintaining the patient under normobaric conditions for a surface interval of twenty-four hours or less; and upon the conclusion of the surface interval, performing a second hyperbaric oxygen therapy treatment on the patient at a second pressure selected from 1.4 ATA to 3.3 ATA, the second pressure being different from the first pressure.

20. The method of claim 19, wherein the injury is a concussion or traumatic brain injury.

* * * * *